US012241665B2

(12) United States Patent
Inaba

(10) Patent No.: US 12,241,665 B2
(45) Date of Patent: Mar. 4, 2025

(54) COMPRESSOR AND COMPRESSOR SYSTEM

(71) Applicant: MAYEKAWA MFG. CO., LTD., Tokyo (JP)

(72) Inventor: Takashige Inaba, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 170 days.

(21) Appl. No.: 18/041,474

(22) PCT Filed: Aug. 27, 2021

(86) PCT No.: PCT/JP2021/031447
§ 371 (c)(1),
(2) Date: Feb. 13, 2023

(87) PCT Pub. No.: WO2022/050180
PCT Pub. Date: Mar. 10, 2022

(65) Prior Publication Data

US 2023/0296297 A1 Sep. 21, 2023

(30) Foreign Application Priority Data

Sep. 3, 2020 (JP) ..... 2020-148513

(51) Int. Cl.
*F25B 31/00* (2006.01)
*F04B 19/22* (2006.01)
(Continued)

(52) U.S. Cl.
CPC ..... *F25B 31/008* (2013.01); *F04B 19/22* (2013.01); *F04B 53/08* (2013.01); *F25B 1/10* (2013.01); *F25B 31/023* (2013.01)

(58) Field of Classification Search
CPC ..... F25B 31/008; F25B 31/023; F25B 1/10; F04B 19/22; F04B 53/08; F04B 27/0538;
(Continued)

(56) References Cited

U.S. PATENT DOCUMENTS 3,300,997 A 1/1967 Kocher
4,006,602 A 2/1977 Fanberg
(Continued)

FOREIGN PATENT DOCUMENTS

CN 101331319 A 12/2008
CN 202073751 U 12/2011
(Continued)

OTHER PUBLICATIONS

English translation of Written Opinion issued in Intl. Appln. No. PCT/JP2021/031447 mailed Oct. 12, 2021, previously cited in IDS filed Feb. 13, 2023.
(Continued)

*Primary Examiner* — Emmanuel E Duke
(74) *Attorney, Agent, or Firm* — Rossi, Kimms & McDowell LLP

(57) ABSTRACT

A compressor according to an embodiment includes: a cylinder; a piston configured to be reciprocable in the cylinder; a suction space capable of communicating with a working chamber formed by the cylinder and the piston; a discharge space capable of communicating with the working chamber; a partition wall portion disposed so as to surround the working chamber, and separating the suction space and the discharge space; and a cooling medium path formed in the partition wall portion.

12 Claims, 7 Drawing Sheets

(51) Int. Cl.
*F04B 53/08* (2006.01)
*F25B 1/10* (2006.01)
*F25B 31/02* (2006.01)

(58) Field of Classification Search
CPC .. F04B 39/1066; F04B 39/121; F04B 39/125; F04B 39/064; F04B 41/06
See application file for complete search history.

(56) References Cited

U.S. PATENT DOCUMENTS

| | | | |
|---|---|---|---|
| 8,674,574 | B2 | 3/2014 | Hayslett et al. |
| 2006/0115367 | A1 | 6/2006 | Koelzer et al. |
| 2009/0071324 | A1 | 3/2009 | Hartl et al. |
| 2009/0301109 | A1 | 12/2009 | Manole |
| 2011/0203304 | A1 | 8/2011 | Sato et al. |
| 2011/0300006 | A1 | 12/2011 | Larminat |
| 2013/0323101 | A1 | 12/2013 | Lucchi |
| 2015/0159919 | A1 | 6/2015 | Sato et al. |

FOREIGN PATENT DOCUMENTS

| | | | | |
|---|---|---|---|---|
| CN | 103470468 | A | 12/2013 | |
| DE | 102015225069 | A1 * | 6/2017 | ..... F04B 25/00 |
| FR | 2327424 | A1 | 5/1977 | |
| JP | S60122289 | A | 6/1985 | |
| JP | 2010053765 | A | 3/2010 | |
| JP | 2010514969 | A | 5/2010 | |
| JP | 2011163192 | A * | 8/2011 | |
| WO | WO-0175306 | A1 * | 10/2001 | ..... F04B 39/066 |
| WO | 2008079969 | A1 | 7/2008 | |

OTHER PUBLICATIONS

International Preliminary Report on Patentability issued in Intl. Appln. No. PCT/JP2021/031447 mailed Mar. 16, 2023. English translation provided.
Office Action issued in Taiwanese Appln. No. 110132276 on May 6, 2022.
Office Action issued in Taiwanese Appln. No. 110132276 on Oct. 20, 2022.
Extended European Search Report issued in European Appln. No. 21864238.7, mailed Dec. 5, 2023.
Office Action issued in Taiwanese Appln. No. 110132276 mailed Jan. 30, 2024.
International Search Report issued in Intl. Appln. No. PCT/JP2021/031447 mailed Oct. 12, 2021. English translation provided.
Written Opinion issued in Intl. Appln. No. PCT/JP2021/031447 mailed Oct. 12, 2021.

* cited by examiner

COMPRESSOR AND COMPRESSOR SYSTEM

TECHNICAL FIELD

The present disclosure relates to a compressor and a compressor system.

BACKGROUND

A reciprocating compressor generally includes a suction gas passage and a discharge gas passage in a casing. Therefore, a high-temperature discharge gas and a low-temperature suction gas may exchange heat via s wall surface of the casing, and a temperature of the suction gas may increase before the suction gas is sucked into the cylinder. Consequently, the suction gas may expand before being sucked into the cylinder and increase in specific volume, and the mass flow rate of the discharge gas may decrease to an unignorable extent. Therefore, volumetric efficiency is decreased in the compressor, and refrigeration capacity may be decreased if the reciprocating compressor is incorporated in a refrigeration system.

Therefore, as means for suppressing overheating of the compressor, for example, a pipe for flowing cooling water is provided inside a crankcase or a head cover. Patent Document 1, 2 discloses a configuration for suppressing overheating of a suction gas by injecting a refrigerant liquid into a discharge space in a head cover and cooling a compressed discharge gas with latent heat of vaporization of the refrigerant liquid.

CITATION LIST

Patent Literature

Patent Document 1: JP2010-53765A
Patent Document 2: JP2011-163192A

SUMMARY

Technical Problem

According to the configuration disclosed in Patent Document 1, 2, it is possible to suppress overheating of the suction gas by cooling the discharge gas. However, due to an influence of cooling of the discharge gas, a large amount of frost may occur on a surface of the compressor (for example, a surface of the head cover or the casing). Such configuration where the large amount of frost occurs is not preferable.

The present disclosure has been made in view of the above-described problems, and an object of the present disclosure is to suppresses heat input from a discharge space to a suction space and to prevent a decrease in volumetric efficiency of the compressor due to the heat input from the discharge space to the suction space while reducing a risk that frost adheres to the surface of the compressor.

Solution to Problem

In order to achieve the above object, a compressor according to the present disclosure includes: a cylinder; a piston configured to be reciprocable in the cylinder; a suction space capable of communicating with a working chamber formed by the cylinder and the piston; a discharge space capable of communicating with the working chamber; a partition wall portion disposed so as to surround the working chamber, and separating the suction space and the discharge space; and a cooling medium path formed in the partition wall portion.

Further, a compressor system according to the present disclosure includes: the above-described compressor; a refrigerant circulation path communicating with the suction space and the discharge space of the compressor; a condenser for condensing a discharge gas discharged from the discharge space; and a branch path branching off from the refrigerant circulation path downstream of the condenser and communicating with the cooling medium path.

Advantageous Effects

With a compressor according to the present disclosure, since a cooling medium is supplied to a cooling medium part formed in a partition wall portion separating a suction space and a discharge space, it is possible to suppresses heat input from the discharge space to the suction space and to prevent a decrease in volumetric efficiency of the compressor due to the heat input from the discharge space to the suction space while reducing a risk that frost adheres to a compressor surface. Further, in addition to the above-described technical effects, if the compressor system according to the present disclosure is applied to a refrigeration system or a heat pump system, it is possible to suppress a decrease in COP.

DETAILED DESCRIPTION

Figure 1:
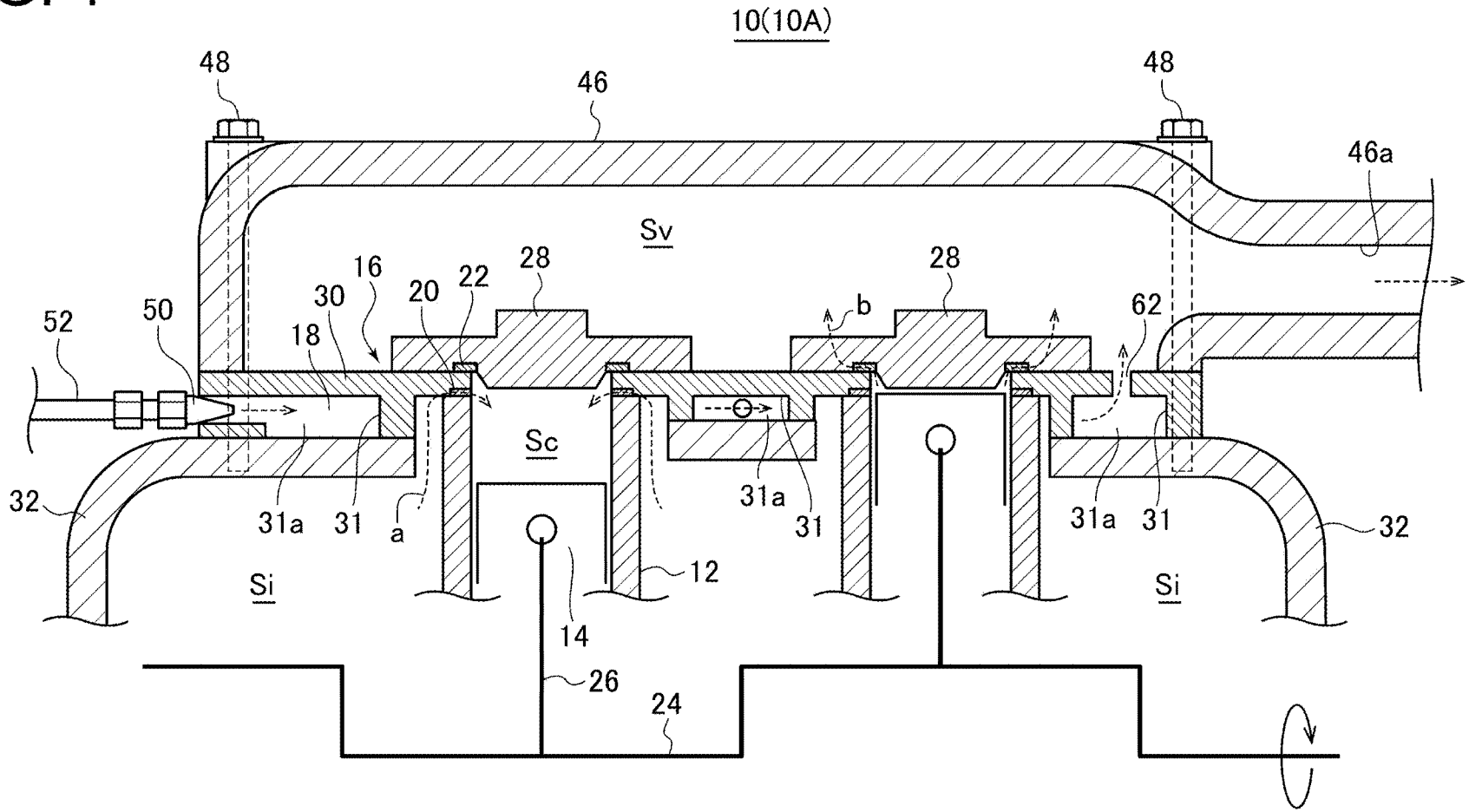
FIG. 1 is a front cross-sectional view of a reciprocating compressor according to an embodiment.

Some embodiments of the present invention will be described below with reference to the accompanying drawings. It is intended, however, that unless particularly specified, dimensions, materials, shapes, relative positions and the like of components described or shown in the drawings as the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, an expressions such as "comprising", "including", "having", "containing", and "constituting" one constitutional element are not intended to be exclusive of other constitutional elements.

Figure 2:
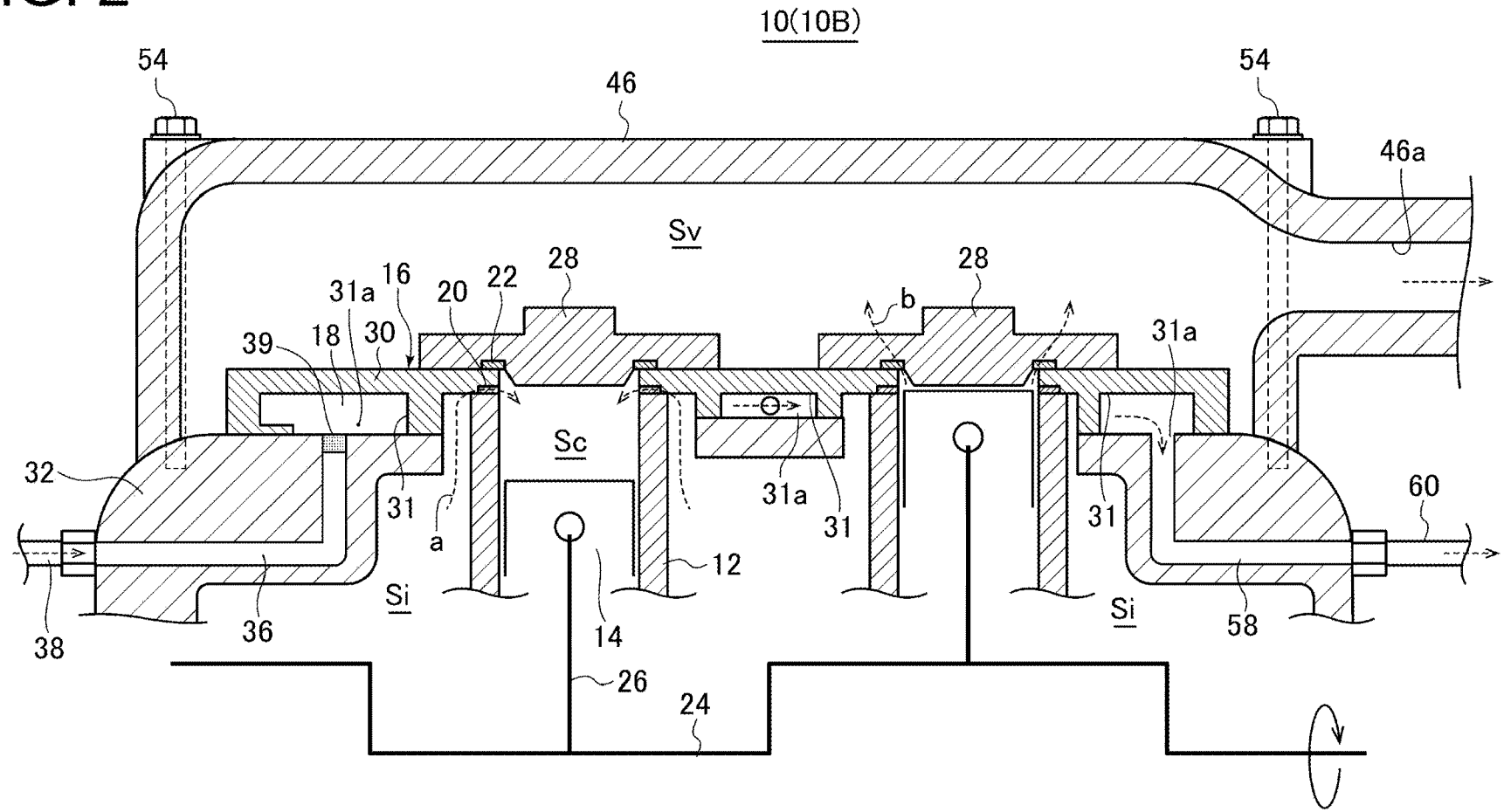
FIG. 2 is a front cross-sectional view of a reciprocating compressor according to an embodiment.
Figure 3:
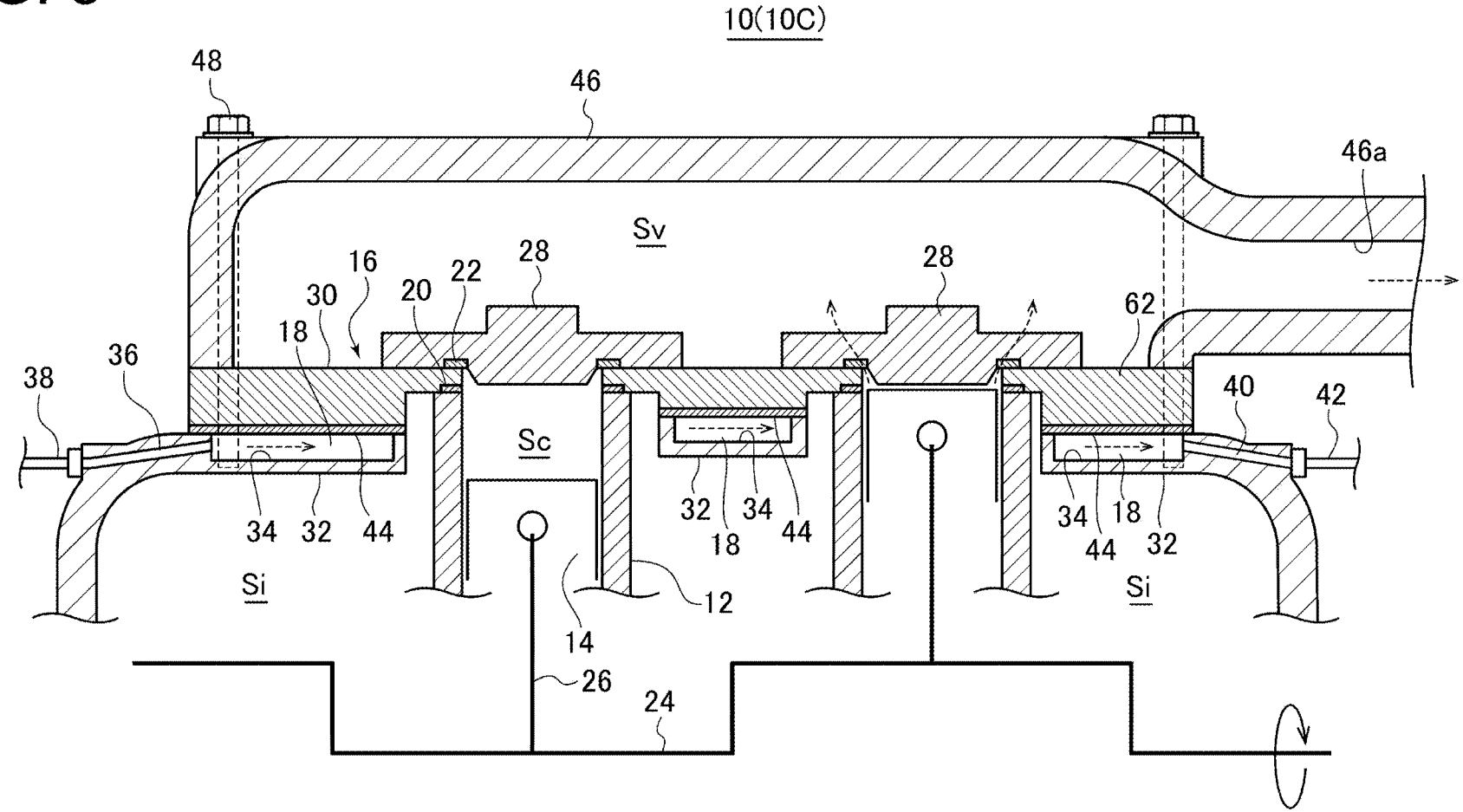
FIG. 3 is a front cross-sectional view of a reciprocating compressor according to an embodiment.

FIGS. 1 to 3 are front cross-sectional views of a compressor 10 (10A, 10B, 10C) according to some embodiments. In FIGS. 1 to 3, the compressor 10 (10A to 10C) includes a cylinder 12 and a piston 14 configured to be reciprocable in the cylinder 12, and the cylinder 12 and the piston 14 form a working chamber Sc. The compressor 10 (10A to 10C) also includes a suction space Si and a discharge space Sv each of which can communicate with the working chamber Sc. Further, a partition wall portion 16 is disposed so as to surround the working chamber Sc, and the partition wall portion 16 separates the suction space Si and the discharge space Sv. The partition wall portion 16 is provided with a suction valve 20 for switching a state of communication between the suction space Si and the working chamber Sc, and a discharge valve 22 for switching a state of communication between the discharge space Sv and the working chamber Sc, and a cooling medium path 18 for flowing a cooling medium is formed.

In the above-described embodiment, the suction gas that has been sucked into the suction space Si is sucked into the working chamber Sc through a passage opened and closed by the suction valve 20, and is compressed by the piston 14. The suction gas that has been compressed to high temperature and high pressure is discharged to the discharge space Sv through a passage opened and closed by the discharge valve 22. By flowing the cooling medium through the cooling medium path 18 formed in the partition wall portion 16 separating the suction space Si and the discharge space Sv, heat input from the discharge space Sv to the suction space Si can be deterred, making it possible to suppress a decrease in volumetric efficiency of the compressor 10 due to the heat input from the discharge space Sv to the suction space Si. On the other hand, since the partition wall portion 16 disposed in the compressor 10 is away from the compressor surface, a decrease in temperature on the compressor surface is suppressed. Therefore, it is possible to suppress occurrence of frost on the compressor surface.

The embodiments shown in FIGS. 1 to 3 constitute a so-called reciprocating compressor. A crank shaft 24 is disposed at the bottom, and the piston 14 is connected to the crank shaft 24 via a connecting rod 26. With a rotation of the crank shaft 24, the piston 14 reciprocates in the cylinder 12. In the exemplary reciprocating compressor shown in FIGS. 1 to 3, two cylinders 12 are disposed parallel to the crank shaft 24, and each piston 14 is connected to the crank shaft 24 so as to reciprocate at phase angles different by 180°. An upper surface of the cylinder 12 is closed by a valve cage 28, and a head cover 46 for forming the discharge space Sv is provided above the partition wall portion 16. The head cover 46 is formed with an opening 46*a* for delivering the discharge gas.

As the cooling medium supplied to the cooling medium path 18, for example, cooling water, an antifreeze liquid, or the like can be used. Further, if the compressor 10 is incorporated in a refrigeration system or a heat pump system, a refrigerant liquid can be used as a working fluid for these systems.

In an embodiment, as shown in FIGS. 1 and 2, the partition wall portion 16 includes a valve plate 30 for holding the suction valve 20 and the discharge valve 22, and the cooling medium path 18 is formed in the valve plate 30. The valve plate 30 is cooled by flowing the cooling medium through the cooling medium path 18, making it possible to deter the heat input from the discharge space Sv to the suction space Si. Thus, it is possible to suppress the decrease in volumetric efficiency of the compressor 10 due to the heat input from the discharge space Sv to the suction space Si. On the other hand, since the discharge space Sv or the like is interposed between the valve plate 30 and the compressor surface (for example, the surface of the head cover 46), the decrease in temperature on the compressor surface (for example, the surface of the head cover 46) is suppressed. Therefore, it is possible to suppress occurrence of frost on the compressor surface.

In an embodiment, as shown in FIGS. 1 to 3, the compressor 10 (10A to 10C) includes a compressor casing 32 for containing the suction space Si, and housing the cylinder 12 and the piston 14. In the embodiments shown in FIGS. 1 and 2, the valve plate 30 is formed with a first channel groove 31 having an opening 31*a* on a compressor casing 32 side, and the cooling medium path 18 is constituted by the first channel groove 31.

According to the present embodiment, since the cooling medium path 18 is constituted by the first channel groove 31, there is no need to form a deep hole in the valve plate 30, and the cooling medium path 18 can be formed by being cut from the surface of the valve plate 30. This facilitates processing for forming the cooling medium path 18 in the valve plate 30. Further, since the first channel groove 31 has the opening 31*a* on the compressor casing 32 side, the suction space Si can be cooled with the cooling medium flowing through the cooling medium path 18.

In an embodiment, the first channel groove 31 is formed into a circular shape so as to surround the circumference of the cylinder 12. In the exemplary embodiment shown in FIG. 1, an outer peripheral edge portion of valve plate 30 is exposed to the outside of the head cover 46. The cooling medium path 18 has a through hole 33 opening to an end face of the peripheral edge portion, and is mounted with an injection nozzle 50 for injecting the cooling medium to the through hole 33. Further, a supply pipe 52 for supplying the cooling medium to the injection nozzle 50 is connected. The valve plate 30 can uniformly be cooled with the cooling medium sprayed from the injection nozzle 50. Moreover, on an opposite side of a compressor body and a supply side of the cooling medium, a communication path 62 communicating with the cooling medium path 18 and the discharge space Sv is formed in a partition wall of the valve plate 30, and the cooling medium is discharged to the discharge space Sv through the communication path 62.

In the exemplary embodiment shown in FIG. 2, a wall portion of the compressor casing 32 is formed with a supply path 36 for supplying the cooling medium to the first channel groove 31, and the supply path 36 is connected to a supply pipe 38 for supplying the cooling medium. By thus forming the supply path 36 in the wall portion of the compressor casing 32, the supply path for supplying the cooling medium to the first channel groove 31 is formed easily. Further, a throttle 39 is provided at an outlet where the cooling medium supplied from the supply pipe 38 to the supply path 36 opens to the cooling medium path 18. The cooling medium turns into mist by passing through the throttle 39 and is sprayed to the cooling medium path 18. The throttle 39 is composed of, for example, a plug which has a plurality of small-diameter through holes communicating with the supply path 36 and the cooling medium path 18. In another embodiment, instead of providing the throttle 39, an outlet opening diameter of the supply path 36 may be decreased to function as a throttle. On the other hand, in the compressor casing 32 on the opposite side of the compressor body with respect to the supply path 36, a discharge path 58 for discharging the cooling medium after being used for cooling from the first channel groove 31 is formed, and a refrigerant discharge path 60 is connected to an outer opening of the discharge path 58.

In the compressor 10 (10B) shown in FIG. 2, even if the head cover 46 needs to be removed for maintenance, the supply pipe 38 need not be removed from the compressor casing 32, facilitating maintenance work.

In the exemplary embodiments shown in FIGS. 1 to 3, the compressor casing 32 doubles as a crankcase, and the crank shaft 24 is housed inside the compressor casing 32.

In an embodiment, a heat-insulating gasket may be inserted into a laminated portion of the valve plate 30 and the compressor casing 32. In this case, however, if the gasket is disposed in an area of the first channel groove 31, a cooling effect of the suction gas flowing through the suction space Si is inhibited, and thus the gasket should not be disposed in the opening 31*a*.

In an embodiment, as shown in FIG. 3, a second channel groove 34 is formed in a surface of the compressor casing 32 on the valve plate 30 side, and the cooling medium path 18 is constituted by the second channel groove 34. According to the present embodiment, the partition wall portion 16 including the valve plate 30 can be cooled by flowing the cooling medium through the cooling medium path 18, making it possible to deter the heat input from the discharge space Sv to the suction space Si. Thus, it is possible to suppress the decrease in volumetric efficiency of the compressor 10 due to the heat input from the discharge space Sv to the suction space Si. On the other hand, even if the cooling medium is flowed through the cooling medium path 18, since the discharge space Sv or the like is interposed between the valve plate 30 and the compressor surface, the decrease in temperature on the compressor surface (for example, the surface of the head cover 46) is suppressed. Therefore, it is possible to suppress occurrence of frost on the compressor surface. Further, since the cooling medium path 18 can be formed by cutting the surface of the compressor casing 32, the cooling medium path 18 is formed easily.

In an embodiment, as shown in FIG. 3, in order to supply the cooling medium to the second channel groove 34, the supply path 36 is formed in the compressor casing 32 and the supply pipe 38 is connected to an outer opening of the supply path 36. On the other hand, in the compressor casing 32 on the opposite side of the compressor body with respect to the supply path 36, a discharge path 40 for discharging the cooling medium after being used for cooling from the second channel groove 34 is formed, and a refrigerant discharge path 42 is connected to an outer opening of the discharge path 40.

In an embodiment, as shown in FIG. 3, a heat-insulating gasket 44 is interposed on an abutment surface between the valve plate 30 and the compressor casing 32 abutting each other. The heat-insulating gasket 44 is interposed, for example, on the entire abutment surface between the valve plate 30 and the compressor casing 32, including a region where the second channel groove 34 is formed. By providing the heat-insulating gasket 44, it is possible to effectively suppress the heat input from the discharge space Sv to the suction space Si existing inside the compressor casing 32.

In an embodiment, as shown in FIGS. 1 and 3, the outer peripheral edge portion of the valve plate 30 is interposed between an outer peripheral edge portion of the compressor casing 32 and an outer peripheral edge portion of the head cover 46. Thus, the outer peripheral edge portions of the three layers, namely, the head cover 46, the valve plate 30, and the compressor casing 32 are fastened together with fasteners such as bolts, making it easier to mount the valve plate 30 on the compressor body. Further, in the embodiment shown in FIG. 1, an end face of the outer peripheral edge portion of the valve plate 30 is exposed to the outside of the compressor 10, making it easier to dispose the injection nozzle 50 at the opening of the through hole 33 communicating with the cooling medium path 18.

In the exemplary embodiments shown in FIGS. 1 and 3, the outer peripheral edge portions of the head cover 46, the valve plate 30, and the compressor casing 32 are fastened together with bolts 48. In the compressor 10 (10B) shown in FIG. 2, the outer peripheral edge portion of the head cover 46 and the outer peripheral edge portion of the compressor casing 32 are connected with bolts 54, and the outer peripheral edge portion of the valve plate 30 is disposed on the inner side of the head cover 46.

Figure 4:
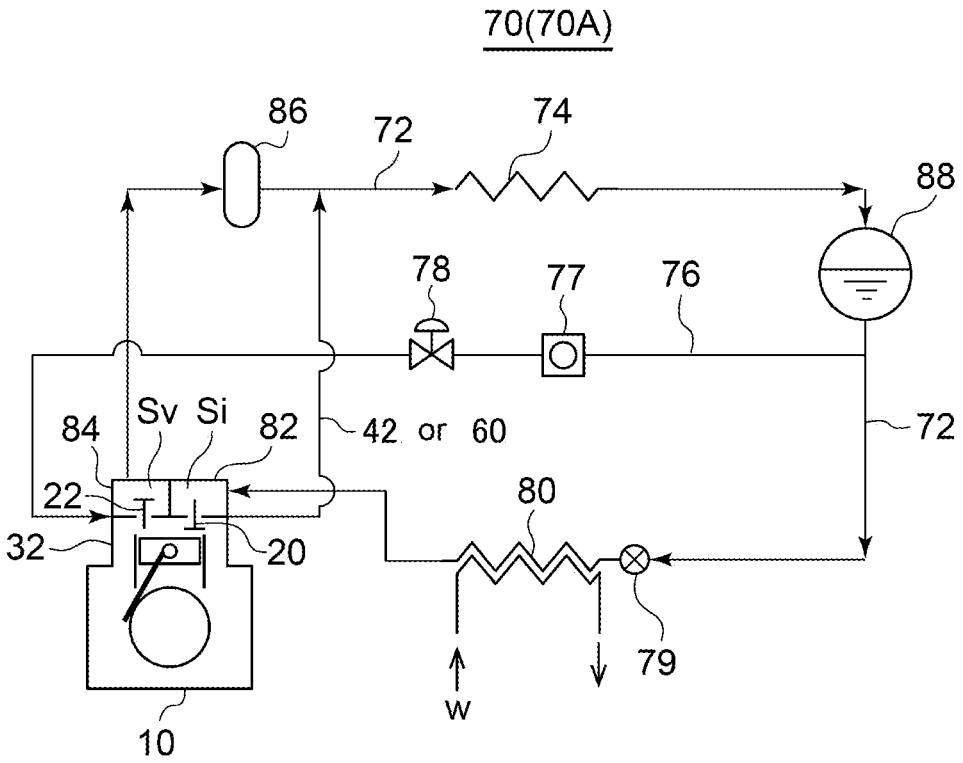
FIG. 4 is a system diagram of a compressor system according to an embodiment.
Figure 5:
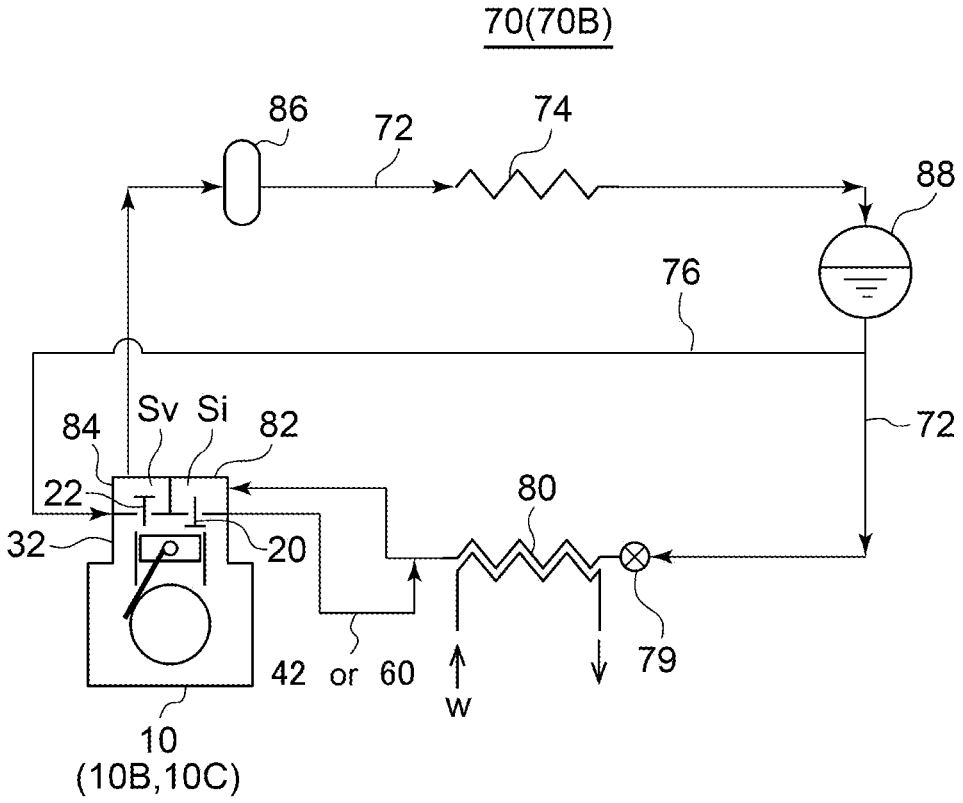
FIG. 5 is a system diagram of a compressor system according to an embodiment.

FIGS. 4 and 5 are system diagrams showing a compressor system 70 (70A, 70B) according to some embodiments. A refrigerant circulation path 72 of the compressor system 70 (70A, 70B) is provided with the compressor 10 (10A to 10C) according to the above-described embodiments. The compressor system 70 includes the refrigerant circulation path 72 communicating with the suction space Si and the discharge space Sv of the compressor 10. The refrigerant circulation path 72 includes a condenser 74 for condensing a refrigerant gas discharged from the discharge space Sv, and a branch path 76 branching off from the refrigerant circulation path 72 downstream of the condenser 74 and communicating with the cooling medium path 18.

The compressor system 70 (70A, 70B) constitutes a refrigeration system. The refrigerant gas discharged from the discharge space Sv is cooled by the condenser 74 and liquefied, and most of the liquefied refrigerant is decompressed by an expansion valve 79 disposed on the refrigerant circulation path 72 and is evaporated by an evaporator 80 to cool a load medium w. The refrigerant gas vaporized by the evaporator 80 is sucked into a suction chamber 82 forming the suction space Si of the compressor 10. The refrigerant gas sucked into the suction chamber 82 is pressurized by the compressor 10 and discharged to the refrigerant circulation path 72 via a discharge chamber 84 forming the discharge space Sv. The branch path 76 branching off from the refrigerant circulation path 72 is disposed downstream of the condenser 74. The branch path 76 communicates with the cooling medium path 18 formed in the partition wall portion 16 of the compressor 10. Apart of the refrigerant liquid flowing through the refrigerant circulation path 72 is supplied to the cooling medium path 18 via the branch path 76 to cool the partition wall portion 16.

In the exemplary embodiments shown in FIGS. 4 and 5, provided are an oil separator 86 for separating refrigerator oil from the refrigerant gas discharged from the compressor 10, and a liquid receiver 88 for temporarily storing the refrigerant liquid condensed in the condenser 74. Further, the compressor 10 is constituted by the reciprocating compressor.

The branch path 76 of the compressor system 70 (70A) shown in FIG. 4 is provided with a liquid pump 77. If the compressor 10 (10A) shown in FIG. 1 is used in the compressor system 70 (70A), the branch path 76 and the discharge space Sv have the same pressure, requiring the liquid pump 77 in order to supply the refrigerant liquid from the branch path 76 to the cooling medium path 18. By pressurizing the refrigerant liquid flowing through the branch path 76 with the liquid pump 77, the refrigerant liquid can be supplied to the cooling medium path 18. By providing a pressure regulating valve 78 downstream of the liquid pump 77 as necessary, it is possible to regulate the pressure of the refrigerant liquid flowing through the branch path 76. The refrigerant liquid, which has flowed into the cooling medium path 18 having a lower pressure than the branch path 76, evaporates under low pressure and absorbs heat of evaporation from the surroundings, making it possible to cool the partition wall portion 16.

Thus, it is possible to suppress the heat input from the discharge space Sv to the suction space Si, and it is possible to suppress the decrease in volumetric efficiency of the compressor 10 due to the above-described heat input. Further, if the compressor 10 is applied to the refrigeration system or a heat pump system like the compressor system 70 (70A, 70B), it is possible to suppress a decrease in COP of these systems. Furthermore, the discharge space Sv or the like is interposed between the partition wall portion 16 and the compressor surface (for example, the surface of the head cover 46) and the partition wall portion 16 is away from the compressor surface, suppressing the decrease in temperature on the compressor surface (for example, the surface of the head cover 46). Therefore, it is possible to suppress occurrence of frost on the compressor surface.

Since the compressor system 70 (70A) shown in FIG. 4 includes the liquid pump 77, if the compressor 10 (10B) shown in FIG. 2 or the compressor 10 (10C) shown in FIG. 3 is used as the compressor 10, the refrigerant discharge path 42 or 60 can be connected to any location in the refrigerant circulation path 72 by appropriately setting a pressurizing force of the liquid pump 77. Preferably, by connecting the refrigerant discharge path 42 or 60 to the refrigerant circulation path 72 upstream of the condenser 74 (for example, the refrigerant circulation path 72 between the oil separator 86 and the condenser 74), it is not necessary to return the refrigerant that has been used to cool the partition wall portion 16 to the refrigerant circulation path 72 on the downstream side of the expansion valve 79. Therefore, the supply of the refrigerant to the cooling medium path 18 does not lower performance of the compressor 10. Since the injection is from the high-pressure liquid and the amount of the refrigerant is small, an influence of the power increase by the liquid pump is small.

The compressor system 70 (70B) shown in FIG. 5 is an embodiment in which the compressor 10 (10B, 10C) shown in FIG. 2 or 3 is used as the compressor 10. In the present embodiment, the branch path 76 is not provided with the liquid pump 77, and the refrigerant discharge path 42 or 60 is connected to the refrigerant circulation path 72 between the expansion valve 79 and the compressor 10 (10B, 10C). Since the refrigerant circulation path 72 in this area has the lower pressure than the branch path 76, even if the branch path 76 is not provided with the liquid pump 77, the refrigerant liquid supplied from the branch path 76 to the cooling medium path 18 can be discharged to the refrigerant circulation path 72 in this area via the refrigerant discharge path 42 or 60. Occurrence of liquid back can be prevented by performing control such that the refrigerant liquid is completely vaporized in the cooling medium path.

Figure 6:
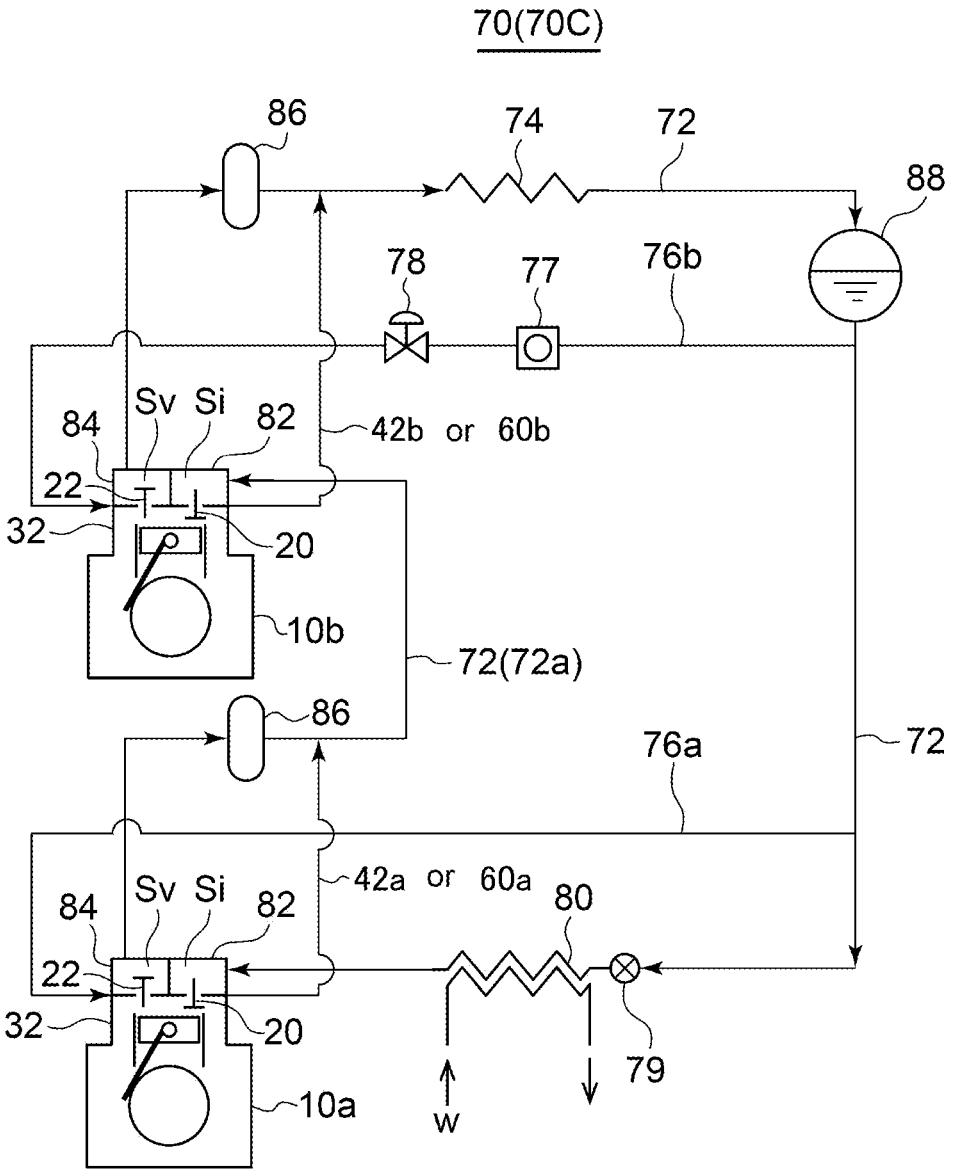
FIG. 6 is a system diagram of a compressor system according to an embodiment.
Figure 7:
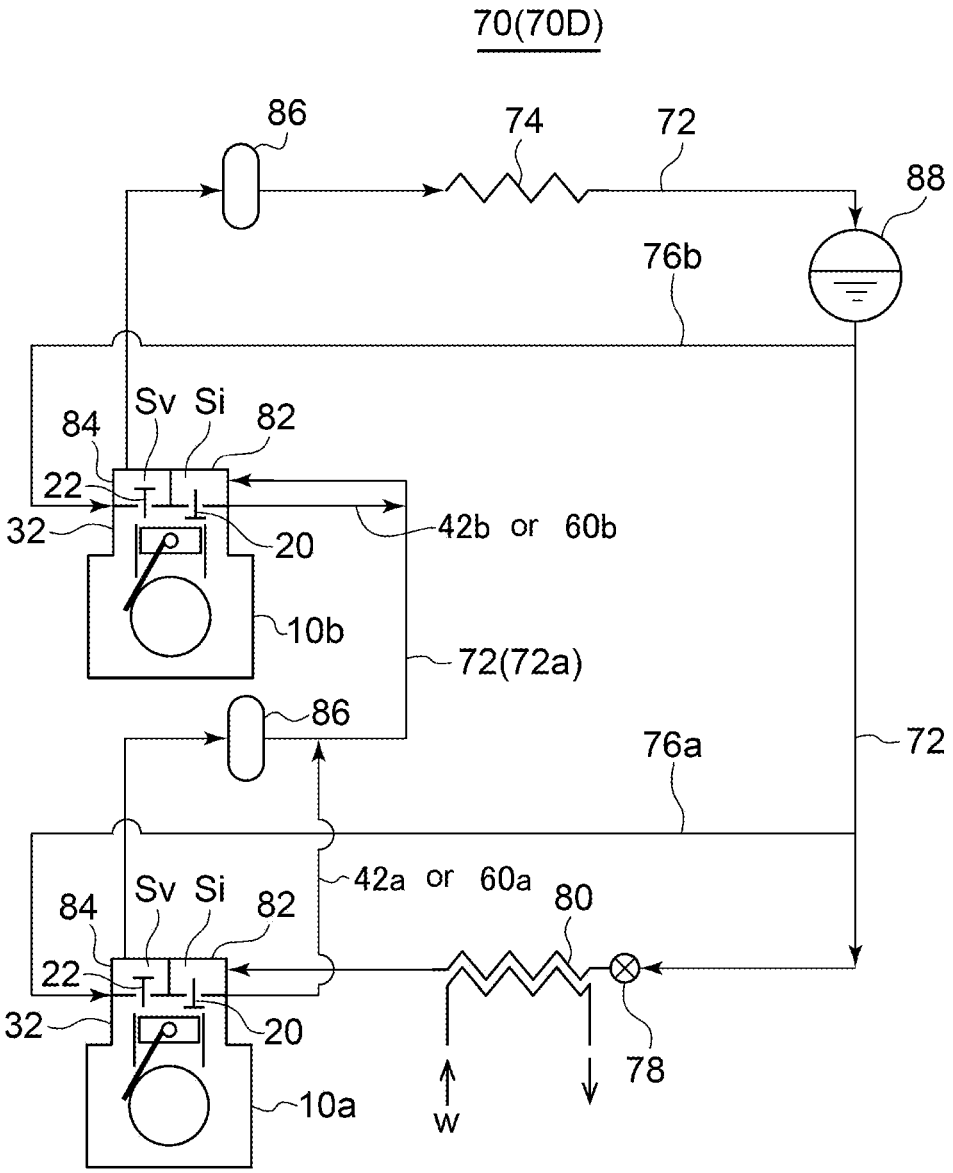
FIG. 7 is a system diagram of a compressor system according to an embodiment.

The compressor system 70 (70C, 70D) shown in FIGS. 6 and 7 includes a low-stage compressor 10*a* and a high-stage compressor 10*b* disposed in series on the refrigerant circulation path 72. The refrigerant gas discharged from the discharge chamber 84 of the low-stage compressor 10*a* is supplied to the suction chamber 82 of the high-stage compressor 10*b* through the refrigerant circulation path 72 (intermediate path 72 (72*a*)) disposed between the low-stage compressor 10*a* and the high-stage compressor 10*b*. The refrigerant gas supplied to the suction chamber 82 of the high-stage compressor 10*b* is further compressed and is discharged from the discharge chamber 84 to the refrigerant circulation path 72.

The compressor system 70 (70C, 70D) shown in FIGS. 6 and 7 constitutes the refrigeration system, and the refrigerant decompressed by the expansion valve 79 is evaporated by the evaporator 80 and removes latent heat of vaporization from the load medium w to cool the load medium w. In the exemplary embodiments shown in FIGS. 6 and 7, two oil separators 86 for separating the refrigerator oil from the refrigerant gas discharged from the compressor 10 (the low-stage compressor 10*a* and the high-stage compressor 10*b*), and the liquid receiver 88 for temporarily storing the refrigerant liquid condensed in the condenser 74. Further, the low-stage compressor 10*a* and the high-stage compressor 10*b* are each constituted by the reciprocating compressor.

In the embodiment where the partition wall portion 16 of the low-stage compressor 10*a* is cooled, a branch path 76*a* is provided which branches off from the refrigerant circulation path 72 on the downstream side of the condenser 74 and on the upstream side of the expansion valve 79 and communicates with the cooling medium path 18 of the low-stage compressor 10*a*. The compressor 10 (10A to 10C) shown in FIGS. 1 to 3 can be used as the low-stage compressor 10*a*. When the compressor 10 (10B, 10C) is used, a refrigerant discharge path 42*a* or 60*a* is connected to the intermediate path 72 (72*a*). The intermediate path 72 (72*a*) has a lower pressure than the branch path 76*a*. Therefore, due to a differential pressure between the branch path 76*a* and the intermediate path 72 (72*a*), the refrigerant liquid diverted from the refrigerant circulation path 72 to the branch path 76*a* is discharged to the intermediate path 72 (72*a*) via the cooling medium path 18 and the communication path 62 in the case of the compressor 10 (10A), and is discharged to the intermediate path 72 (72*a*) via the cooling medium path 18 and the refrigerant discharge path 42*a* or 60*a* in the case of the compressor 10 (10B, 10C).

Among the embodiments where the partition wall portion 16 of the high-stage compressor 10*b* is cooled, in the embodiment shown in FIG. 6, a branch path 76*b* is provided which branches off from the refrigerant circulation path 72 on the downstream side of the condenser 74 and on the upstream side of the expansion valve 79 and communicates with the refrigerant circulation path 72 of the high-stage compressor 10*b*. The compressor 10 (10A to 10C) shown in FIGS. 1 to 3 can be used as the high-stage compressor 10*b*. The branch path 76*b* is provided with the liquid pump 77 and, if necessary, the pressure regulating valve 78. When the compressor 10 (10B, 10C) is used, a refrigerant discharge path 42*b* or 60*b*, through which the refrigerant after cooling the partition wall portion 16 in the cooling medium path 18 is discharged, is connected to any location in the refrigerant circulation path 72. The refrigerant liquid diverted from the refrigerant circulation path 72 to the branch path 76 is pressurized by the liquid pump 77, and thus can be supplied to the cooling medium path 18 of the high-stage compressor 10*b*. The refrigerant after cooling the partition wall portion 16 is returned to the refrigerant circulation path 72 via the refrigerant discharge path 42*b* or 60*b*.

Preferably, the refrigerant discharge path 42*b* or 60*b* is connected to the refrigerant circulation path 72 on the upstream side of the condenser 74 (for example, the refrigerant circulation path 72 between the oil separator 86 and the condenser 74). Thus, it is not necessary to return the refrigerant that has been used to cool the partition wall portion 16 to the intermediate path 72 (72*a*) or the refrigerant circulation path 72 on the downstream side of the expansion valve 79. Therefore, the supply of the refrigerant to the cooling medium path 18 does not lower performance of the compressor.

Among the embodiments where the partition wall portion 16 of the high-stage compressor 10*b* is cooled, in the embodiment shown in FIG. 7, the liquid pump 77 and the pressure regulating valve 78 need not be disposed on the branch path 76*b*. Instead, the refrigerant discharge path 42*b* or 60*b* is connected to the intermediate path 72 (72*a*). Since the pressure of the intermediate path 72 (72*a*) is lower than the pressure of the branch path 76*b*, the refrigerant supplied from the branch path 76*b* to the cooling medium path 18 can smoothly be discharged to the intermediate path 72 (72*a*) via the refrigerant discharge path 42*b* or 60*b*.

In the embodiments shown in FIGS. 6 and 7, both the low-stage compressor 10*a* and the high-stage compressor 10*b* include means for cooling the compressors. However, only either of the low-stage compressor 10*a* or the high-stage compressor 10*b* may include the cooling means.

Further, in another embodiment, the compressor system 70 can be applied to a single-machine two-stage compressor. When the compressor system 70 is applied to the refrigeration system, it is the cooling effect of the low-stage compressor that most influences the refrigeration capacity. The single-machine two-stage compressor includes a low-stage compressor and a high-stage compressor housed in one casing. Therefore, the low-stage compressor is susceptible to a temperature increase by the high-stage compressor. By applying the compressor system 70 to the single-machine two-stage compressor, the refrigeration capacity can be maintained high.

The contents described in the above embodiments would be understood as follows, for instance.

1) A compressor (10) according to an aspect includes: a cylinder (12); a piston (14) configured to be reciprocable in the cylinder; a suction space (Si) capable of communicating with a working chamber (Sc) formed by the cylinder and the piston; a discharge space (Sv) capable of communicating with the working chamber; a partition wall portion (16) disposed so as to surround the working chamber, and separating the suction space and the discharge space; and a cooling medium path (18) formed in the partition wall portion.

With such configuration, by forming the cooling medium path in the partition wall portion separating the suction space and the discharge space and flowing the cooling medium through the cooling medium path, heat input from the discharge space to the suction space can be deterred, making it possible to suppress a decrease in volumetric efficiency of the compressor due to the heat input from the discharge space to the suction space. On the other hand, since the partition wall portion disposed in the compressor is away from the compressor surface, a decrease in temperature on the compressor surface (for example, the surface of the head cover 46) is suppressed. Therefore, it is possible to suppress occurrence of frost on the compressor surface.

2) A compressor (10) according to another aspect is the compressor (10) as defined in 1), including: a suction valve (20) for switching a state of communication between the suction space (Si) and the working chamber (Sc); a discharge valve (22) for switching a state of communication between the discharge space (Sv) and the working chamber; and a valve plate (30) for holding the suction valve and the discharge valve. The cooling medium path (18) is formed in the valve plate serving as the partition wall portion (16).

With such configuration, by forming the cooling medium path in the above-described valve plate and cooling the cooling medium path, the heat input from the discharge space to the suction space can be deterred, making it possible to suppress the decrease in volumetric efficiency of the compressor due to the heat input from the discharge space to the suction space. On the other hand, since the valve plate disposed in the compressor is away from the compressor surface, the decrease in temperature on the compressor surface (for example, the surface of the head cover 46) is suppressed. Therefore, it is possible to suppress occurrence of frost on the compressor surface.

3) The compressor (10) according to still another aspect is the compressor as defined in 2), including: a compressor casing (32) for including the suction space (Si), and housing the cylinder (12) and the piston (14). The valve plate (30) is formed with a first channel groove (31) in a surface on a side of the compressor casing. At least a part of the cooling medium path (18) is formed by the first channel groove.

With such configuration, since the at least part of the cooling medium path is formed by the above-described first channel groove, it is not necessary to form a deep hole in the valve plate when the cooling medium path is formed in the valve plate. This facilitates processing for forming the cooling medium path. Further, since the first channel groove has the opening on the compressor casing side, the suction space can be cooled with the cooling medium flowing through the cooling medium path.

4) A compressor (10) according to yet another aspect is the compressor as defined in 1), including: a suction valve (20) for switching a state of communication between the suction space (Si) and the working chamber (Sc); a discharge valve (22) for switching a state of communication between the discharge space (Sv) and the working chamber; a valve plate (30) for holding the suction valve and the discharge valve; and a compressor casing (32) for housing the cylinder and the piston. The compressor casing is formed with a second channel groove (34) in a surface on a side of the valve plate. At least a part of the cooling medium path (18) is formed by the second channel groove.

With such configuration, since the above-described cooling medium path can be formed by cutting the surface of the compressor casing, the cooling medium path is formed easily.

5) A compressor (10) according to yet another aspect is the compressor as defined in 4), including: a heat-insulating gasket (44) interposed on an abutment surface between the valve plate (30) and the compressor casing (32).

With such configuration, by providing the above-described heat-insulating gasket, it is possible to further suppress the heat input from the discharge space to the suction space disposed on the compressor casing side.

6) A compressor (10) according to yet another aspect is the compressor as defined in any one of 3) to 5), including: a head cover (46) forming the discharge space (Sv) together with the valve plate (30). An outer peripheral edge portion of the valve plate is interposed between an outer peripheral edge portion of the compressor casing (32) and an outer peripheral edge portion of the head cover.

With such configuration, the outer peripheral edge portions of the three layers, namely, the head cover, the valve plate, and the compressor casing are fastened together with fasteners such as bolts, making it easier to mount the valve plate. Further, the outer peripheral edge portion of the valve plate is exposed to the outside, making it easier to externally connect the refrigerant supply pipe to the cooling medium path formed in the valve plate.

7) A compressor system (70) according to an aspect includes: the above-described compressor (10 (10A, 10B, 10C)); a refrigerant circulation path (72) communicating with the suction space (Si) and the discharge space (Sv) of the compressor; a condenser (74) for condensing a discharge gas discharged from the discharge space; at least one branch path (76) branching off from the refrigerant circulation path downstream of the condenser and communicating with the cooling medium path (18); and a liquid pump (77) disposed on the branch path.

With such configuration, the refrigerant liquid flowing through the above-described branch path is pressurized by the liquid pump, and thus can be supplied to the cooling medium path. Consequently, since the partition wall portion disposed in the compressor is cooled, making it possible to suppress the decrease in volumetric efficiency of the compressor due to the heat input from the discharge space to the suction space. Thus, if the compressor system of the present disclosure is applied to the refrigeration system or the heat pump system, it is possible to suppress a decrease in COP (coefficient of performance). Further, since the partition wall portion disposed in the compressor is away from the compressor surface, the decrease in temperature on the compressor surface is suppressed. Therefore, it is possible to suppress occurrence of frost on the compressor surface.

8) A compressor system (70) according to another aspect is the compressor system as defined in 7), including: a refrigerant discharge path (42, 60) for returning a cooling medium discharged from the cooling medium path (18) of the compressor (10 (10A, 10B)) to the refrigerant circulation path (72). The refrigerant discharge path is connected to the refrigerant circulation path between the compressor and the condenser (74).

With such configuration, the refrigerant liquid pressurized by the liquid pump and supplied to the cooling medium path can be returned to the refrigerant circulation path on the high-pressure side between the compressor and the condenser. Therefore, the refrigerant used to cool the partition wall portion can be used as the working refrigerant of the compressor, and thus the supply of the refrigerant for cooling to the cooling medium path does not lower the performance of the compressor.

9) A compressor system according to an aspect includes: the above-described compressor (10 (10A, 10B, 0C)); a refrigerant circulation path (72) communicating with the suction space (Si) and the discharge space (Sv) of the compressor; a condenser (74) for condensing a discharge gas discharged from the discharge space; an expansion valve (79) for decompressing a condensate liquid of the discharge gas condensed in the condenser; at least one branch path (76) branching off from the refrigerant circulation path between the condenser and the expansion valve, and communicating with the cooling medium path (18); and a refrigerant discharge path (42, 60) for returning a cooling medium discharged from the cooling medium path of the compressor to the refrigerant circulation path between the expansion valve and the compressor.

With such configuration, since the refrigerant circulation path between the expansion valve and the compressor has the lower pressure than the branch path, even if the branch path is not provided with the liquid pump, the refrigerant supplied to the cooling medium path can be returned to the refrigerant circulation path in the low-pressure area in question via the refrigerant discharge path.

10) A compressor system (70) according to an aspect includes: a refrigerant circulation path (72); a low-stage compressor (10*a*) and a high-stage compressor (10*b*) disposed in series in the refrigerant circulation path; and a condenser (74) for condensing a discharge gas discharged from the discharge space of the high-stage compressor. The low-stage compressor is constituted by the above-described compressor (10 (10A to 10C)). The compressor system includes: a branch path (76*a*) branching off from the refrigerant circulation path downstream of the condenser (74) and communicating with the cooling medium path of the low-stage compressor; and a refrigerant discharge path (42*a*, 60*a*) for returning a cooling medium discharged from the cooling medium path (18) of the low-stage compressor to the refrigerant circulation path (intermediate path 72 (72*a*)) between the low-stage compressor and the high-stage compressor.

With such configuration, since the above-described intermediate path has a lower pressure than the branch path 76*a*, the refrigerant gas after cooling the partition wall portion in the cooling medium path of the low-stage compressor can be returned to the intermediate path via the refrigerant discharge path.

11) A compressor system (70) according to an aspect includes: a refrigerant circulation path (72); a low-stage compressor (10*a*) and a high-stage compressor (10*b*) disposed in series in the refrigerant circulation path; and a condenser (74) for condensing a discharge gas discharged from the discharge space (Sv) of the high-stage compressor. The high-stage compressor is constituted by the above-described compressor (10 (10A to 0C)). The compressor system includes: a branch path (76*b*) branching off from the refrigerant circulation path downstream of the condenser and communicating with the cooling medium path (18) of the high-stage compressor; a liquid pump (77) disposed on the branch path; and a refrigerant discharge path (42*b*, 60*b*) for returning a cooling medium discharged from the cooling medium path of the high-stage compressor to the refrigerant circulation path.

With such configuration, since the refrigerant liquid supplied from the above-described branch path to the cooling medium path of the high-stage compressor is pressurized by the liquid pump, the refrigerant liquid can be supplied to the cooling medium path of the high-stage compressor, and the refrigerant after cooling the partition wall portion in the refrigerant discharge path can be returned to the refrigerant circulation path via the refrigerant discharge path.

12) A compressor system (70) according to an aspect includes: a refrigerant circulation path (72); a low-stage compressor (10*a*) and a high-stage compressor (10*b*) disposed in series in the refrigerant circulation path; and a condenser (74) for condensing a discharge gas discharged from the discharge space (Sv) of the high-stage compressor. The high-stage compressor is constituted by the above-described compressor (10 (10B, 0C)). The compressor system includes: a branch path (76*b*) branching off from the refrigerant circulation path downstream of the condenser and communicating with the cooling medium path of the high-stage compressor; and a refrigerant discharge path (42*b*, 60*b*) for returning a cooling medium discharged from the cooling medium path (18) of the high-stage compressor to the refrigerant circulation path (intermediate path 72 (72*a*)) disposed between the low-stage compressor and the high-stage compressor.

With such configuration, since the refrigerant liquid flowing through the above-described branch path has a higher pressure than the above-described intermediate path, the refrigerant liquid supplied from the branch path to the cooling medium path of the high-stage compressor can be returned to the intermediate path via the refrigerant discharge path after cooling the partition wall portion.

REFERENCE SIGNS LIST

10 (10A, 10B, 10C, 10*a*, 10*b*) Compressor
10*a* Low-stage compressor
10*b* High-stage compressor
12 Cylinder
14 Piston
16 Partition wall portion
18 Cooling medium path
20 Suction valve
22 Discharge valve
24 Crank shaft
26 Connecting rod
28 Valve cage
30 Valve plate
31 First channel groove
31*a* Opening
32 Compressor casing
33, 56 Through hole
34 Second channel groove
36 Supply path
38, 52 Supply pipe
39 Throttle
40, 58 Discharge path
42, 42*a*, 42*b*, 60, 60*a*, 60*b* Cooling medium discharge path
44 Heat-insulating gasket
46 Head cover
46*a* Opening
48, 54 Bolt
50 Injection nozzle
62 Communicating path
70 (70A, 70B) Compressor system
72 Refrigerant circulation path
74 Condenser
76, 76*a*, 76*b* Branch path
78 Expansion valve
80 Evaporator
82 Suction chamber
84 Discharge chamber
Sc Working chamber
Si Suction space
Sv Discharge space

The invention claimed is:

1. A compressor, comprising:
a cylinder;
a piston configured to be reciprocable in the cylinder in a reciprocating direction;
a suction space capable of communicating with a working chamber formed by the cylinder and the piston;
a discharge space capable of communicating with the working chamber;
a partition wall portion disposed so as to surround the working chamber, and separating the suction space and the discharge space from each other such that the suction space and the discharge space are separated from each other in the reciprocating direction of the piston with the partition wall being disposed between the suction space and the discharge space; and
a cooling medium path formed in the partition wall portion that separates the suction space and the discharge space from each other in the reciprocating direction of the piston.

2. The compressor according to claim 1, comprising:
a suction valve for switching a state of communication between the suction space and the working chamber;
a discharge valve for switching a state of communication between the discharge space and the working chamber; and
a valve plate for holding the suction valve and the discharge valve,
wherein the cooling medium path is formed in the valve plate serving as the partition wall portion.

3. The compressor according to claim 2, comprising:
a compressor casing for including the suction space, and housing the cylinder and the piston,
wherein the valve plate is formed with a first channel groove in a surface on a side of the compressor casing, and
wherein at least a part of the cooling medium path is formed by the first channel groove.

4. The compressor according to claim 3, comprising:
a head cover forming the discharge space together with the valve plate,
wherein an outer peripheral edge portion of the valve plate is interposed between an outer peripheral edge portion of the compressor casing and an outer peripheral edge portion of the head cover.

5. The compressor according to claim 1, comprising:
a suction valve for switching a state of communication between the suction space and the working chamber;
a discharge valve for switching a state of communication between the discharge space and the working chamber;
a valve plate for holding the suction valve and the discharge valve; and
a compressor casing for housing the cylinder and the piston,
wherein the compressor casing is formed with a second channel groove in a surface on a side of the valve plate, and
wherein at least a part of the cooling medium path is formed by the second channel groove.

6. The compressor according to claim 5, comprising:
a heat-insulating gasket interposed on an abutment surface between the valve plate and the compressor casing.

7. A compressor system, comprising:
a refrigerant circulation path;
a low-stage compressor and a high-stage compressor disposed in series in the refrigerant circulation path; and
a condenser for condensing a discharge gas discharged from the discharge space of the high-stage compressor,
wherein the low-stage compressor is constituted by the compressor according to claim 1, and
wherein the compressor system comprises:
a branch path branching off from the refrigerant circulation path downstream of the condenser and communicating with the cooling medium path of the low-stage compressor; and
a refrigerant discharge path for returning a cooling medium discharged from the cooling medium path of the low-stage compressor to the refrigerant circulation path between the low-stage compressor and the high-stage compressor.

8. A compressor system, comprising:
a refrigerant circulation path;

a low-stage compressor and a high-stage compressor disposed in series in the refrigerant circulation path; and a condenser for condensing a discharge gas discharged from the discharge space of the high-stage compressor, wherein the high-stage compressor is constituted by the compressor according to claim 1, and wherein the compressor system comprises:

a branch path branching off from the refrigerant circulation path downstream of the condenser and communicating with the cooling medium path of the high-stage compressor;

a liquid pump disposed on the branch path; and a refrigerant discharge path for returning a cooling medium discharged from the cooling medium path of the high-stage compressor to the refrigerant circulation path.

9. A compressor system, comprising:

a refrigerant circulation path;

a low-stage compressor and a high-stage compressor disposed in series in the refrigerant circulation path; and a condenser for condensing a discharge gas discharged from the discharge space of the high-stage compressor, wherein the high-stage compressor is constituted by the compressor according to claim 1, and wherein the compressor system comprises:

a branch path branching off from the refrigerant circulation path downstream of the condenser and communicating with the cooling medium path of the high-stage compressor; and a refrigerant discharge path for returning a cooling medium discharged from the cooling medium path of the high-stage compressor to the refrigerant circulation path disposed between the low-stage compressor and the high-stage compressor.

10. A compressor system, comprising:

a compressor including:

a cylinder;

a piston configured to be reciprocable in the cylinder;

a suction space capable of communicating with a working chamber formed by the cylinder and the piston;

a discharge space capable of communicating with the working chamber;

a partition wall portion disposed so as to surround the working chamber, and separating the suction space and the discharge space; and a cooling medium path formed in the partition wall portion;

a refrigerant circulation path communicating with the suction space and the discharge space of the compressor;

a condenser for condensing a discharge gas discharged from the discharge space;

at least one branch path branching off from the refrigerant circulation path downstream of the condenser and communicating with the cooling medium path; and a liquid pump disposed on the branch path.

11. The compressor system according to claim 10, comprising:

a refrigerant discharge path for returning a cooling medium discharged from the cooling medium path of the compressor to the refrigerant circulation path, wherein the refrigerant discharge path is connected to the refrigerant circulation path between the compressor and the condenser.

12. A compressor system, comprising:

a compressor including:

a cylinder;

a piston configured to be reciprocable in the cylinder;

a suction space capable of communicating with a working chamber formed by the cylinder and the piston;

a discharge space capable of communicating with the working chamber;

a partition wall portion disposed so as to surround the working chamber, and separating the suction space and the discharge space; and a cooling medium path formed in the partition wall portion;

a refrigerant circulation path communicating with the suction space and the discharge space of the compressor;

a condenser for condensing a discharge gas discharged from the discharge space;

an expansion valve for decompressing a condensate liquid of the discharge gas condensed in the condenser;

at least one branch path branching off from the refrigerant circulation path between the condenser and the expansion valve, and communicating with the cooling medium path; and a refrigerant discharge path for returning a cooling medium discharged from the cooling medium path of the compressor to the refrigerant circulation path between the expansion valve and the compressor.

* * * * *